US009968967B2

(12) United States Patent
Heichel et al.

(10) Patent No.: US 9,968,967 B2
(45) Date of Patent: May 15, 2018

(54) VIBRATION EXCITER

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Thomas Specht, Kleinheubach (DE); Manuel Meinel, Aschaffenburg (DE); Albrecht Kleibl, Grosshennersdorf (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 785 days.

(21) Appl. No.: 14/554,302

(22) Filed: Nov. 26, 2014

(65) Prior Publication Data

US 2015/0202657 A1 Jul. 23, 2015

(30) Foreign Application Priority Data

Jan. 21, 2014 (EP) ..... 14151994

(51) Int. Cl.
*B06B 1/16* (2006.01)
*E02D 3/074* (2006.01)

(52) U.S. Cl.
CPC ..... *B06B 1/16* (2013.01); *B06B 1/166* (2013.01); *E02D 3/074* (2013.01); *Y10T 74/2117* (2015.01)

(58) Field of Classification Search
CPC ..... E02D 3/054; E02D 3/074; E02D 7/18; B06B 1/16; B06B 1/166; Y10T 74/18344
See application file for complete search history.

(56) References Cited

U.S. PATENT DOCUMENTS 5,177,386 A * 1/1993 Shimada ..... B06B 1/166 310/81
5,253,542 A * 10/1993 Houze ..... B06B 1/162 173/49
8,225,685 B2 * 7/2012 Heichel ..... B06B 1/166 74/61

* cited by examiner

*Primary Examiner* — Thomas C Diaz
(74) *Attorney, Agent, or Firm* — Collard & Roe, P.C.

(57) ABSTRACT

A vibration exciter, particularly for a vibration pile driver, includes at least four shafts disposed parallel to one another, on which two outer imbalance masses are disposed, in each instance, between which a central imbalance mass is positioned. The central imbalance mass is mounted on the shaft so as to rotate relative to the outer imbalance masses, in each instance. The imbalance masses of the at least four shafts are combined into two imbalance groups, the imbalance masses of which are all synchronized with one another in torsionally rigid manner, in each instance, wherein not only outer imbalance masses but also inner imbalance masses are provided in each of the two imbalance groups, and wherein a phase shifter is provided, by way of which the phasing of the two imbalance groups relative to one another can be adjusted.

8 Claims, 3 Drawing Sheets

VIBRATION EXCITER

CROSS REFERENCE TO RELATED APPLICATIONS

Applicant claims priority under 35 U.S.C. § 119 of European Application No. 14151994.2 filed Jan. 21, 2014, the disclosure of which is incorporated by reference.

BACKGROUND OF THE INVENTION

1. Field of the Invention

The invention relates to a vibration exciter, particularly for a vibration pile driver.

2. Description of the Related Art

In construction, vibration generators such as vibrators, shakers, or vibration bears, are used to introduce profiles into the ground, or to draw them from the ground, or also to compact ground material. The ground is excited using vibration, and thereby achieves a "pseudo-fluid" state. The goods to be driven in can then be pressed into the construction ground by means of a static top load. The vibration has a linear movement and is generated by rotating imbalances that run in opposite directions, in pairs, within a vibrator transmission. Vibration generators are characterized by the installed imbalance, called the "static moment."

In order to achieve an optimal forward drive, i.e. good compaction, as a function of the goods being driven and the ground properties, it is desirable to regulate the amplitude, frequency or force direction of the vibration generator. It is practical if adjustment of the vibration takes place by means of a change in the static moment or the phasing of the imbalances. To adjust the effective value of the imbalance, shafts having non-changeable imbalances are rotated relative to one another, or the active imbalance of each individual shaft is changed.

A particular construction is leader-mounted vibrators. These vibrators are usually equipped with three or four imbalance shafts. Adjustment of the static moment of the vibration generator takes place by means of adjustment of the effective imbalance of each shaft.

In this connection, a central imbalance is regularly rotated against two outer imbalances, in order to adjust the resulting imbalance in this way. In this connection, the sum of the two outer imbalances of each shaft corresponds to the static moment (product of distance from the center of gravity and mass) of the inner imbalance. The two outer imbalances of each shaft are coupled, by way of the shaft itself or by way of gear wheels, so that rotation relative to one another is precluded.

Because the angle between the imbalances on all the imbalance shafts is supposed to be the same, the outer imbalances and the inner imbalances of all the shafts are usually synchronized with one another, in each instance, and combined into groups, using gear wheels, in this connection. All the imbalances whose phasing, relative to one another, remains unchanged when the static moment is changed, form an imbalance group. Regularly, all the inner imbalances form an imbalance group, as do all the outer ones. Coupling between these groups takes place by way of a pivot motor, which shifts the phasing between the imbalance groups or keeps it constant. In the state of the art, there are essentially two concepts: In the first approach, the group of the outer imbalances and the group of the inner imbalances are driven separately, in each instance. The pivot motor solely serves for adjustment and for synchronization or equalization of the torque of the motors, which might be different. The advantage of this approach lies in the low stress on the pivot motors; the disadvantage lies in the great multiplicity of parts. In the case of a vibrator having four imbalance shafts and one pivot motor disposed centrally, for example, here three rows of gear wheels with a total of fourteen gear wheels are required.

In the case of the second concept, an imbalance group is driven directly, whereby the drive of the second imbalance group takes place by way of the pivot motor. In this approach, only two rows of gear wheels with a total of ten gear wheels are required. A disadvantage in this connection is the great stress on the pivot motor because this motor transfers half the drive moment in addition to the adjustment moment.

The previously known vibration generators have the disadvantage that a drive moment must be simultaneously transferred by way of the pivot motor, by way of which coupling of the imbalance groups takes place, and therefore a large-volume design of the pivot motor is required, or instead, three rows of gear wheels are required for synchronization of the imbalances, thereby increasing the component depth and impairing efficiency.

SUMMARY OF THE INVENTION

The invention wants to provide a remedy for these disadvantages. The invention is based on the task of making available a vibration generator in which adjustment of the imbalance groups relative to one another takes place extensively without any transfer of drive moment, and simultaneously, the component depth is slight. According to the invention, this task is accomplished by a vibration exciter, particularly for a vibration pile driver, comprising at least four shafts disposed parallel to one another, on which two outer imbalance masses are disposed, in each instance, between which a central imbalance mass is positioned. The central imbalance mass is mounted on the shaft so as to rotate relative to the outer imbalance masses, in each instance. The imbalance masses of the at least four shafts are combined into two imbalance groups, the imbalance masses of which are all synchronized with one another in torsionally rigid manner, in each instance. Not only outer imbalance masses but also inner imbalance masses are provided in each of the two imbalance groups. A phase shifter is provided, by way of which the phasing of the two imbalance groups relative to one another can be adjusted.

With the invention, a vibration exciter is created, in which adjustment of the imbalance groups relative to one another takes place extensively without any transfer of torque. Because at least four shafts disposed parallel to one another are provided, on which two outer imbalance masses are disposed, in each instance, between which a central imbalance mass is positioned, whereby the central imbalance mass is mounted on the shaft so as to rotate relative to the outer imbalance masses, in each instance, whereby the imbalance masses of the at least four shafts are combined into two imbalance groups, the imbalance masses of which are all synchronized with one another in torsionally rigid manner, in each instance, whereby not only outer imbalance masses but also inner imbalance masses are provided in each of the two imbalance groups, and whereby a phase shifter is provided, by way of which the phasing of the two imbalance groups relative to one another can be adjusted, the pivot motor serves merely for synchronization and adjustment of the imbalance groups relative to one another. In this connection, no drive moment is transferred. In this connection—in contrast to the previously known vibration exciters—no inner and outer imbalance groups are provided. Instead, the imbalance groups, which are driven by one drive motor, in each instance, are formed from outer and inner imbalances. In this connection, the imbalances within an imbalance group always have the same phasing. Furthermore, the torsionally rigid synchronization can be implemented by providing merely two rows of gear wheels.

Preferably, the phase shifter is formed by a pivot motor, particularly a rotary vane pivot motor. In this connection, the housing of the pivot motor can be connected, in torsionally rigid manner, with an inner imbalance of an imbalance group and an outer imbalance of the same group, by way of gear wheels. In this connection, the shaft of the pivot motor is connected with the inner and outer imbalances of the second imbalance group by way of gear wheels. In this way, a change in the angular position of the imbalance groups relative to one another can be achieved by a rotation of the shaft of the pivot motor relative to its housing.

In a further development of the invention, each imbalance group is connected with at least one drive motor, by way of which it can be driven. Because every imbalance group is driven separately, the stress on the phase shifter can be limited to the load caused by the phase shift of the two imbalance groups relative to one another.

It is advantageous if the drive motors are hydraulic motors having the identical displacement. If the sum of the torques of the drive motors of the one group is equal to the sum of the torques of the drive motors of the other group, then the pivot motor does not transfer any drive moment. Because the torque of hydraulic motors results from displacement and pressure, and it is practical if the drive motors of the two groups are driven in parallel on the same hydraulic circuit, in other words the same pressure is applied to them, the motors of each imbalance group should have the same displacement. In this way, it is guaranteed that the phase shifter needs to provide only the moment required for adjustment of the imbalances relative to one another.

In another embodiment of the invention, at least one of the drive motors is a hydraulic adjustable motor having an adjustable displacement. In this connection, preferably a control device is provided, which is connected with the drive motors and set up in such a manner that the activated displacement of the at least one drive motor of the two imbalance groups relative to one another can be identically adjusted. Alternatively or in addition, a control device can be provided that is connected with the drive motors and is set up in such a manner that the activated displacement of the at least one drive motor, in each instance, of one of the two imbalance groups, can be adjusted to be greater and/or smaller as compared with the activated displacement of the at least one drive motor of the second imbalance group, in such a manner that a phase adjustment of the two imbalance groups relative to one another or support of the phase shifter is brought about by means of the difference of the total torque of the at least one drive motor of the one imbalance group relative to the total torque of the at least one drive motor of the second imbalance group. In this way, further stress relief of the phase shifter can be achieved, and the phase shifter can be dimensioned more compactly and with less weight. This effect can be achieved not only in that the two imbalance groups are driven by adjustable motors, but also in that only one imbalance group is driven by an adjustable motor and the other imbalance group is driven by a constant motor having an unchangeable displacement.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters devote similar elements throughout the several views.

DETAILED DESCRIPTION OF PREFERRED EMBODIMENTS

Figure 1:
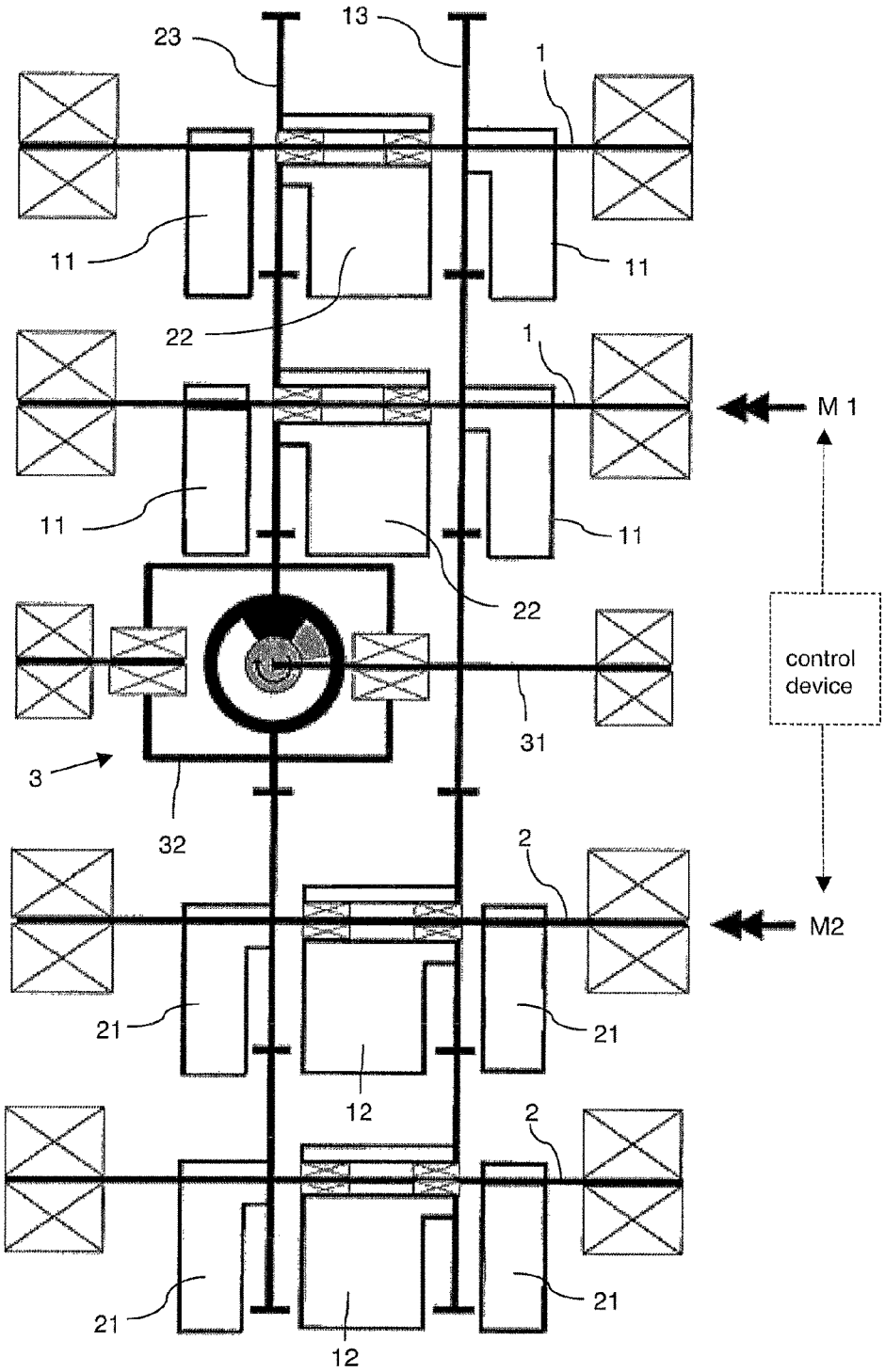
FIG. 1 is a schematic representation of a vibration generator.

The vibration exciter selected as an exemplary embodiment is structured as a four-shaft vibrator transmission. Four imbalance shafts 1, 2 are disposed parallel to one another, on which two outer imbalance masses 11, 21 are attached at a distance from one another.

Centered between the two outer imbalance masses 11, 21, a central imbalance mass 22, 12 is provided, in each instance, which is connected with a gear wheel 13, 23. Two imbalance shafts 1, 2, in each instance, are directly driven by way of a drive motor M1, M2.

Furthermore, a pivot motor 3 is provided, comprising a pivot motor shaft 31 as well as a pivot motor housing 32 that can be pivoted relative to the pivot motor shaft 31. The pivot motor 3 is disposed between the two imbalance shafts 1, 2 that are directly connected with the drive motors M1, M2. In this connection, the pivot motor shaft 31 is connected, by way of gear wheels 13, with the imbalance shafts 1 driven by the drive motor M1, as well as with the imbalance masses 12 mounted so as to rotate on the imbalance shafts 2 driven by the drive motor M2. The pivot motor housing 32 is connected, by way of gear wheels 23, with the shafts 2 driven by the drive motor M2, as well as with the imbalance masses 22 mounted so as to rotate on the shafts 1 driven by the drive motor M1.

Figure 2:
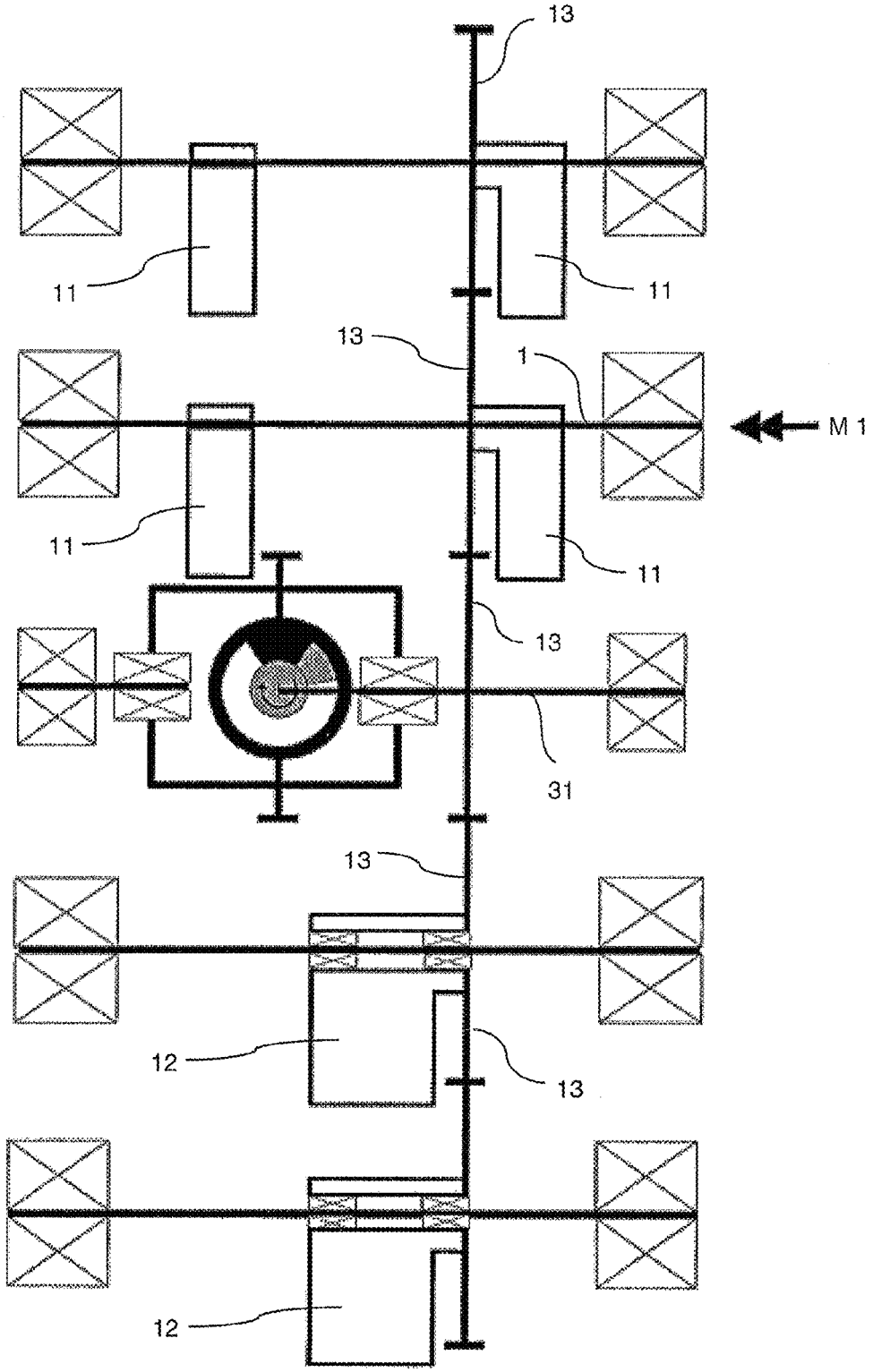
FIG. 2 is a schematic representation of the first imbalance group of the vibration generator.
Figure 3:
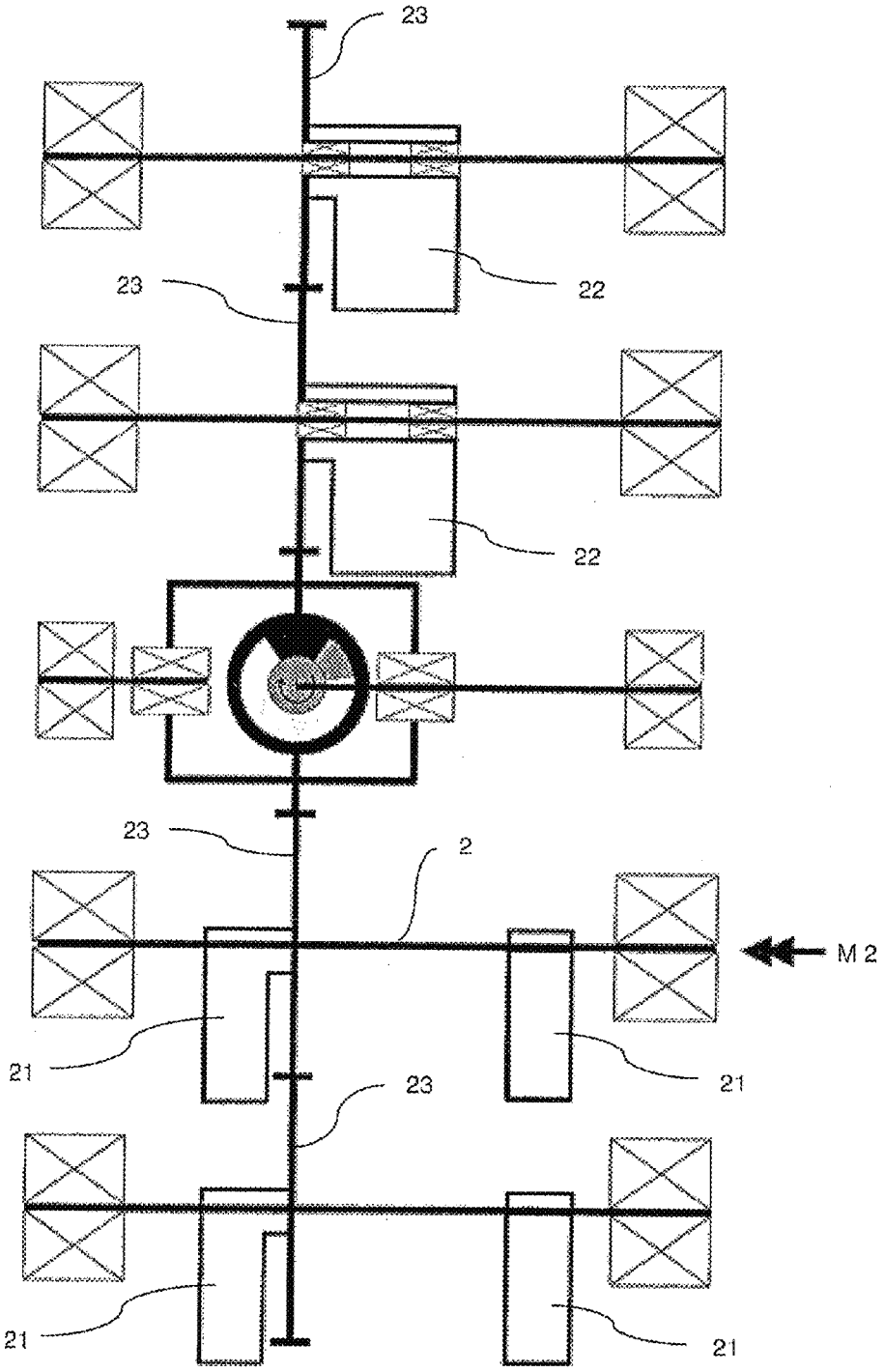
FIG. 3 is a schematic representation of the second imbalance group of the vibration generator from FIG. 1.

In FIG. 2, the imbalance masses 11, 12 connected with the pivot motor shaft by way of gear wheels 13 are shown. These imbalance masses 11, 12, which form a first imbalance group, are driven by way of the drive motor M1. In FIG. 3, the imbalance masses 21, 22 connected with the pivot motor housing by way of gear wheels 23 are shown, which masses are driven by way of the drive motor M2. These imbalance masses 21, 22 form a second imbalance group.

The two drive motors M1, M2 are configured as hydraulic adjustable motors. In the case of hydraulic adjustable motors, the displacement is adjustable. The two drive motors M1, M2 are connected with a control device—not shown—that is set up in such a manner that these drive motors M1, M2 have approximately the same displacement at all times. The task of the pivot motors 3 is restricted to phase shifting and to synchronization of the two imbalance groups.

In the exemplary embodiment, the shaft modules, in other words the shafts 1, 2 with the imbalance masses 11, 21, 12, 22 disposed on them, in each instance, are configured to be the same. The shaft modules below the pivot motor 3 are identical to the shaft modules above the pivot motor 3. In the present case, however, the shaft modules below the pivot motor 3 were installed in a mirror image with regard to the shaft modules above the pivot motor 3.

Although only a few embodiments of the present invention have been shown and described, it is to be understood that many changes and modifications may be made thereunto without departing from the spirit and scope of the invention.

What is claimed is:

1. A vibration exciter comprising:

(a) at least first, second, third, and fourth shafts;

(b) first and second outer imbalance masses and a first central imbalance mass disposed on the first shaft, wherein the first central imbalance mass is positioned between the first and second outer imbalance masses and mounted on the first shaft so as to rotate relative to the first and second outer imbalance masses;

(c) third and fourth outer imbalance masses and a second central imbalance mass disposed on the second shaft, wherein the second central imbalance mass is positioned between the third and fourth outer imbalance masses and mounted on the second shaft so as to rotate relative to the third and fourth outer imbalance masses;

(d) fifth and sixth outer imbalance masses and a third central imbalance mass disposed on the third shaft, wherein the third central imbalance mass is positioned between the fifth and sixth outer imbalance masses and mounted on the third shaft so as to rotate relative to the fifth and sixth outer imbalance masses;

(e) seventh and eighth outer imbalance masses and a fourth central imbalance mass disposed on the fourth shaft, wherein the fourth central imbalance mass is positioned between the seventh and eighth outer imbalance masses and mounted on the fourth shaft so as to rotate relative to the seventh and eighth outer imbalance masses; and (f) a phase shifter;

wherein the outer imbalance masses and the central imbalance masses of the first, second, third, and fourth shafts are combined into first and second imbalance groups;

wherein in each of the first and second imbalance groups are arranged outer imbalance masses as well as central imbalance masses;

wherein the imbalance masses of the first imbalance group are synchronized with one another in torsionally rigid manner and the imbalance masses of the second imbalance group are synchronized with one another in torsionally rigid manner; and wherein phasing of the first and second imbalance groups relative to one another are adjustable by way of the phase shifter.

2. The vibration exciter according to claim 1, wherein the phase shifter is a pivot motor.

3. The vibration exciter according to claim 1, wherein the phase shifter is a rotary vane pivot motor.

4. The vibration exciter according to claim 1, wherein the first imbalance group is connected with at least a first drive motor for driving the first imbalance group and the second imbalance group is connected with at least a second drive motor for driving the second imbalance group.

5. The vibration exciter according to claim 4, wherein the drive motors are hydraulic motors.

6. The vibration exciter according to claim 5, wherein at least one of the first and second drive motors is a hydraulic adjustable motor having an adjustable displacement.

7. The vibration exciter according to claim 6, further comprising a control device connected with the first and second drive motors and set up so that activated displacement of the first and second drive motors of the first and second imbalance groups relative to one another can be identically adjusted.

8. The vibration exciter according to claim 6, further comprising a control device connected with the first and second drive motors and set up so that activated displacement of the first drive motor of the first imbalance group can be adjusted to be greater or smaller as compared with activated displacement of the second drive motor of the second imbalance group, in such a manner that a phase adjustment of the first and second imbalance groups relative to one another or support of the phase shifter is brought about by a difference of a total torque of the first drive motor of the first imbalance group relative to a total torque of the second drive motor of the second imbalance group.

* * * * *